US008142141B2

(12) United States Patent
Tesh et al.

(10) Patent No.: US 8,142,141 B2
(45) Date of Patent: Mar. 27, 2012

(54) APPARATUS FOR TURBINE ENGINE COOLING AIR MANAGEMENT

(75) Inventors: Stephen William Tesh, Simpsonville, SC (US); John Ernest Tourigny, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 616 days.

(21) Appl. No.: 12/409,162

(22) Filed: Mar. 23, 2009

(65) Prior Publication Data

US 2010/0239414 A1 Sep. 23, 2010

(51) Int. Cl.
*F04D 29/08* (2006.01)

(52) U.S. Cl. ..... 415/173.7; 415/173.3

(58) Field of Classification Search ..... 415/173.7, 415/115, 173.1, 173.3, 173.5, 174.2
See application file for complete search history.

(56) References Cited

U.S. PATENT DOCUMENTS 4,436,311 A * 3/1984 Brandon ..... 277/413
4,869,640 A * 9/1989 Schwarz et al. ..... 415/115
5,029,876 A * 7/1991 Orlando et al. ..... 277/419
5,094,551 A * 3/1992 Kitamura et al. ..... 384/518
5,203,673 A * 4/1993 Evans ..... 415/173.2
5,429,478 A * 7/1995 Krizan et al. ..... 415/173.7
5,503,528 A * 4/1996 Glezer et al. ..... 416/96 R
5,967,745 A * 10/1999 Tomita et al. ..... 415/173.7
6,065,934 A * 5/2000 Jacot et al. ..... 416/155
6,077,034 A * 6/2000 Tomita et al. ..... 415/110
6,152,690 A * 11/2000 Tomita et al. ..... 415/173.7
6,250,640 B1 * 6/2001 Wolfe et al. ..... 277/355
6,257,586 B1 * 7/2001 Skinner et al. ..... 277/303
6,331,006 B1 * 12/2001 Baily et al. ..... 277/355
6,394,459 B1 * 5/2002 Florin ..... 277/303
6,427,712 B1 * 8/2002 Ashurst ..... 137/62
6,435,513 B2 * 8/2002 Skinner et al. ..... 277/303
6,506,016 B1 * 1/2003 Wang ..... 415/173.7
6,644,667 B2 * 11/2003 Grondahl ..... 277/355
6,669,443 B2 * 12/2003 Burnett et al. ..... 415/173.7
6,699,015 B2 * 3/2004 Villhard ..... 416/96 A
6,786,487 B2 * 9/2004 Dinc et al. ..... 277/355
6,811,375 B2 * 11/2004 Brisson et al. ..... 415/173.7
7,052,017 B2 * 5/2006 Uchida et al. ..... 277/420
7,059,829 B2 * 6/2006 Garner ..... 415/173.7
7,367,776 B2 * 5/2008 Albers et al. ..... 415/173.1
7,371,044 B2 * 5/2008 Nereim ..... 415/173.7
7,448,849 B1 * 11/2008 Webster et al. ..... 415/173.1
7,520,718 B2 * 4/2009 Engle ..... 415/173.7
7,641,200 B2 * 1/2010 Chevrette ..... 277/303
7,655,001 B2 * 2/2010 Petrakis ..... 604/890.1
7,686,569 B2 * 3/2010 Paprotna et al. ..... 415/1
7,744,092 B2 * 6/2010 Mortzheim ..... 277/303
7,946,808 B2 * 5/2011 Taylor et al. ..... 415/173.7
(Continued)

*Primary Examiner* — Ross Gushi
(74) *Attorney, Agent, or Firm* — Cantor Colburn LLP

(57) ABSTRACT

An exemplary embodiment of the invention is directed to a turbine engine having a rotatable turbine rotor assembly, a stationary nozzle assembly disposed adjacent thereto and a wheel space defined therebetween. The wheel space receives cooling air therein and includes a sealing feature located on the first, rotatable turbine rotor assembly and extending axially into the wheel space and a sealing land assembly having a sealing land associated with a moveable member installed in an opening in the second, stationary nozzle assembly. A biasing member constructed of shape memory alloy is associated with the moveable member and operates to bias the moveable member, and associated sealing land, axially into the wheel space towards the sealing feature as the turbine engine transitions from a cold state to a hot state to reduce the release of cooling air from within the wheel space.

13 Claims, 4 Drawing Sheets

U.S. PATENT DOCUMENTS

| | | | | |
|---|---|---|---|---|
| 7,967,558 | B2 * | 6/2011 | Scricca | 415/173.7 |
| 7,967,559 | B2 * | 6/2011 | Bunker | 415/173.7 |
| 7,976,026 | B2 * | 7/2011 | Verma et al. | 277/355 |
| 8,016,552 | B2 * | 9/2011 | Bunker | 415/173.7 |
| 2001/0006278 | A1 * | 7/2001 | Haje | 277/412 |
| 2002/0130469 | A1 * | 9/2002 | Kono | 277/355 |
| 2002/0190474 | A1 * | 12/2002 | Turnquist et al. | 277/355 |
| 2003/0102630 | A1 * | 6/2003 | Dinc et al. | 277/355 |
| 2003/0156942 | A1 * | 8/2003 | Villhard | 416/96 R |
| 2003/0185669 | A1 * | 10/2003 | Brauer et al. | 415/111 |
| 2004/0018082 | A1 * | 1/2004 | Soechting et al. | 415/115 |
| 2004/0150165 | A1 * | 8/2004 | Grondahl | 277/355 |
| 2004/0211177 | A1 * | 10/2004 | Kutlucinar | 60/527 |
| 2005/0058539 | A1 * | 3/2005 | Diakunchak | 415/173.1 |
| 2007/0243061 | A1 * | 10/2007 | Taylor et al. | 415/173.7 |
| 2008/0079222 | A1 * | 4/2008 | Namuduri et al. | 277/359 |
| 2008/0145208 | A1 * | 6/2008 | Klasing et al. | 415/173.7 |
| 2008/0265514 | A1 * | 10/2008 | Mortzheim | 277/303 |
| 2008/0267770 | A1 * | 10/2008 | Webster et al. | 415/173.1 |
| 2009/0043288 | A1 * | 2/2009 | Petrakis | 604/890.1 |
| 2009/0185896 | A1 * | 7/2009 | Kizuka et al. | 415/115 |
| 2009/0196738 | A1 * | 8/2009 | Kizuka et al. | 415/115 |
| 2009/0196742 | A1 * | 8/2009 | Turnquist et al. | 415/174.2 |
| 2009/0309311 | A1 * | 12/2009 | Verma et al. | 277/411 |
| 2010/0006303 | A1 * | 1/2010 | Garcia et al. | 166/386 |
| 2010/0102518 | A1 * | 4/2010 | Gao et al. | 277/554 |
| 2010/0183426 | A1 * | 7/2010 | Liang | 415/110 |
| 2010/0232938 | A1 * | 9/2010 | Harris et al. | 415/173.1 |
| 2010/0232939 | A1 * | 9/2010 | Piersall et al. | 415/173.1 |
| 2010/0239413 | A1 * | 9/2010 | Tesh et al. | 415/116 |
| 2010/0239414 | A1 * | 9/2010 | Tesh et al. | 415/173.7 |
| 2010/0254806 | A1 * | 10/2010 | Deodhar et al. | 415/173.7 |
| 2011/0182719 | A1 * | 7/2011 | Deo et al. | 415/173.1 |
| 2011/0187054 | A1 * | 8/2011 | Namuduri et al. | 277/300 |

* cited by examiner

APPARATUS FOR TURBINE ENGINE COOLING AIR MANAGEMENT

BACKGROUND OF THE INVENTION

The subject matter disclosed herein relates to gas turbine engines and, more particularly, to temperature and performance management therein.

In a gas turbine engine, air is pressurized in a compressor and mixed with fuel in a combustor for generating hot combustion gas that flows downstream through one or more turbine stages. A turbine stage includes a stationary nozzle having stator vanes that guide the combustion gas through a downstream row of turbine rotor blades. The blades extend radially outwardly from a supporting rotor that is powered by extracting energy from the gas.

A first stage turbine nozzle receives hot combustion gas from the combustor and directs it to the first stage turbine rotor blades for extraction of energy therefrom. A second stage turbine nozzle may be disposed downstream from the first stage turbine rotor blades, and is followed by a row of second stage turbine rotor blades that extract additional energy from the combustion gas. Additional stages of turbine nozzles and turbine rotor blades may be disposed downstream from the second stage turbine rotor blades.

As energy is extracted from the combustion gas, the temperature of the gas is correspondingly reduced. However, since the gas temperature is relatively high, the turbine stages are typically cooled by a coolant such as compressed air diverted from the compressor through the hollow vane and blade airfoils for cooling various internal components of the turbine. Since the cooling air is diverted from use by the combustor, the amount of extracted cooling air has a direct influence on the overall efficiency of the engine. It is therefore desired to improve the efficiency with which the cooling air is utilized to improve the overall efficiency of the turbine engine.

The quantity of cooling air required is dependant not only on the temperature of the combustion gas but on the integrity of the various seals which are disposed between rotating and stationary components of the turbine. Thermal expansion and contraction of the rotor and blades may vary from the thermal expansion of the stationary nozzles and the turbine housing thereby challenging the integrity of the seals. In some cases the seals may be compromised causing excess cooling air to pass into the turbine mainstream gas flow resulting in excess diversion of compressor air translating directly to lower than desired turbine efficiency.

It is therefore desired to provide a gas turbine engine having improved sealing of gas turbine stationary to rotating component interfaces.

BRIEF DESCRIPTION OF THE INVENTION

In an exemplary embodiment of the invention a turbine engine comprises a first turbine engine assembly and a second turbine engine assembly disposed adjacent thereto. A wheel space is defined between the first turbine engine assembly and the second turbine engine assembly and is configured to receive cooling air therein. A sealing feature is located on the first turbine engine assembly and extends axially into the wheel space. A sealing land assembly, having a sealing land associated with a moveable member is installed in an opening in the second turbine assembly. A biasing member, constructed of shape memory alloy, is associated with the moveable member and is configured to bias the moveable member and associated sealing land axially into the wheel space towards the sealing feature as the turbine engines transitions from a cold state to a hot state.

In another exemplary embodiment of the invention a turbine engine comprises a first, rotatable turbine rotor assembly and a second, stationary nozzle assembly disposed adjacent to the first, rotatable turbine rotor assembly. A wheel space defined between the first, rotatable turbine rotor assembly and the second, stationary nozzle assembly is configured to receive cooling air therein. A sealing feature located on the first, rotatable turbine rotor assembly extends axially into the wheel space. A sealing land assembly, having a sealing land associated with a moveable member is installed in an opening in the second, stationary nozzle assembly and a biasing member constructed of shape memory alloy is associated with the moveable member and configured to bias the moveable member and associated sealing land axially into the wheel space towards the sealing feature as the turbine engine transitions from a cold state to a hot state.

In another exemplary embodiment of the invention a turbine engine comprises a turbine housing having an upstream and a downstream end. A stationary nozzle assembly is disposed within the housing in fixed relationship to the housing. A turbine rotor assembly is supported within the housing for rotation therein and is operable, during operation of the turbine engine, to thermally expand relative to the stationary nozzle assembly. A wheel space, defined between the stationary nozzle assembly and the rotatable turbine rotor assembly, is configured to receive cooling air therein. A sealing feature is located on the turbine rotor assembly and extends axially into the wheel space and a sealing land assembly, having a sealing land associated with a moveable member is installed in an opening in the stationary nozzle assembly. A biasing member, constructed of shape memory alloy has a composition such that a phase change from a cold, martensitic state to a hot, austenitic state is within the heat transient of the gas turbine engine. The biasing member is associated with the moveable member and is configured to bias the moveable member, and associated sealing land, axially into the wheel space towards the sealing feature as the turbine engine transitions from a cold state to a hot state.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which.

DETAILED DESCRIPTION OF THE INVENTION

Figure 1:
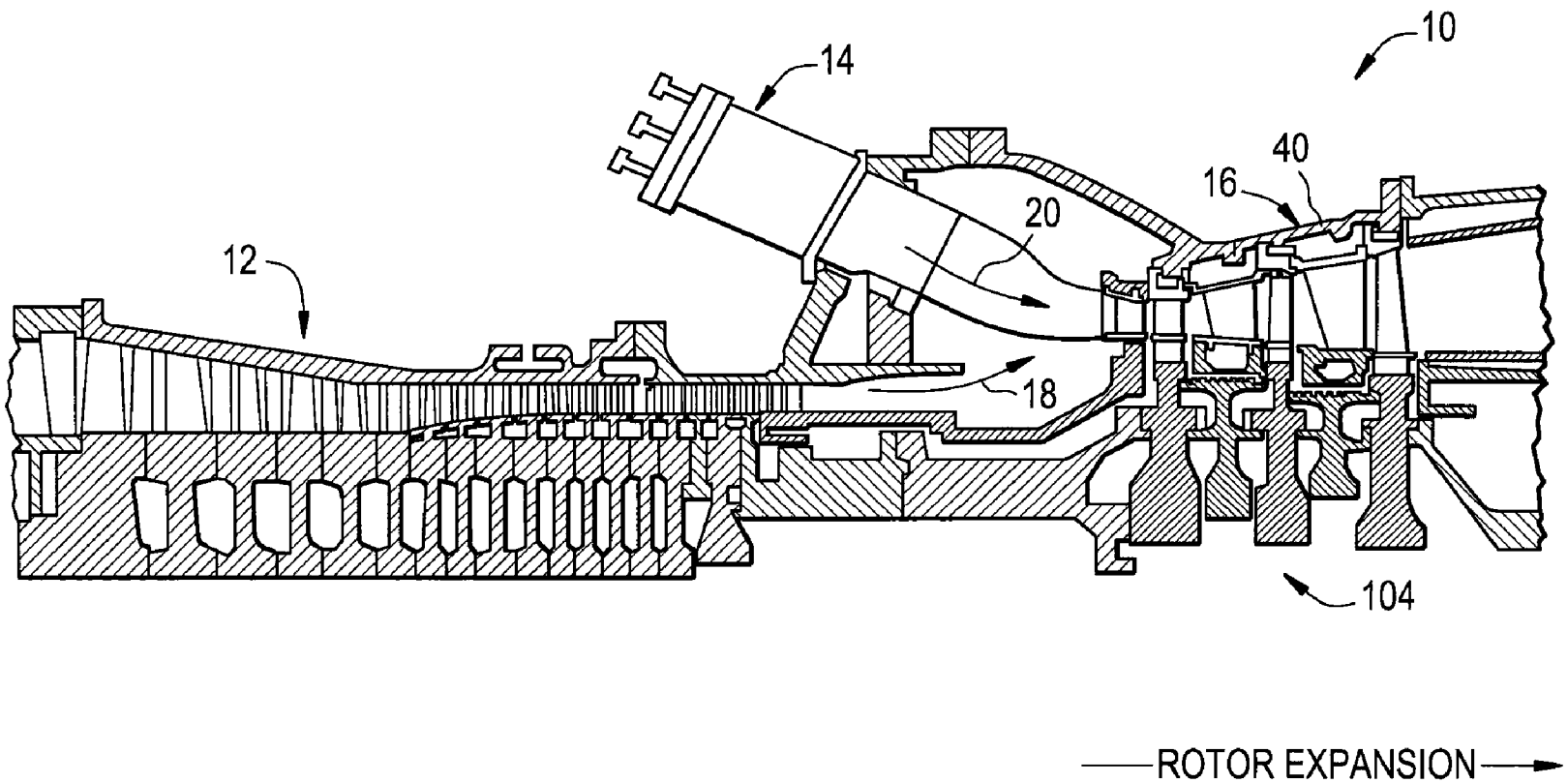
FIG. 1 is an axial sectional view through a portion of an exemplary gas turbine engine in accordance with an embodiment of the invention.
Figure 2:
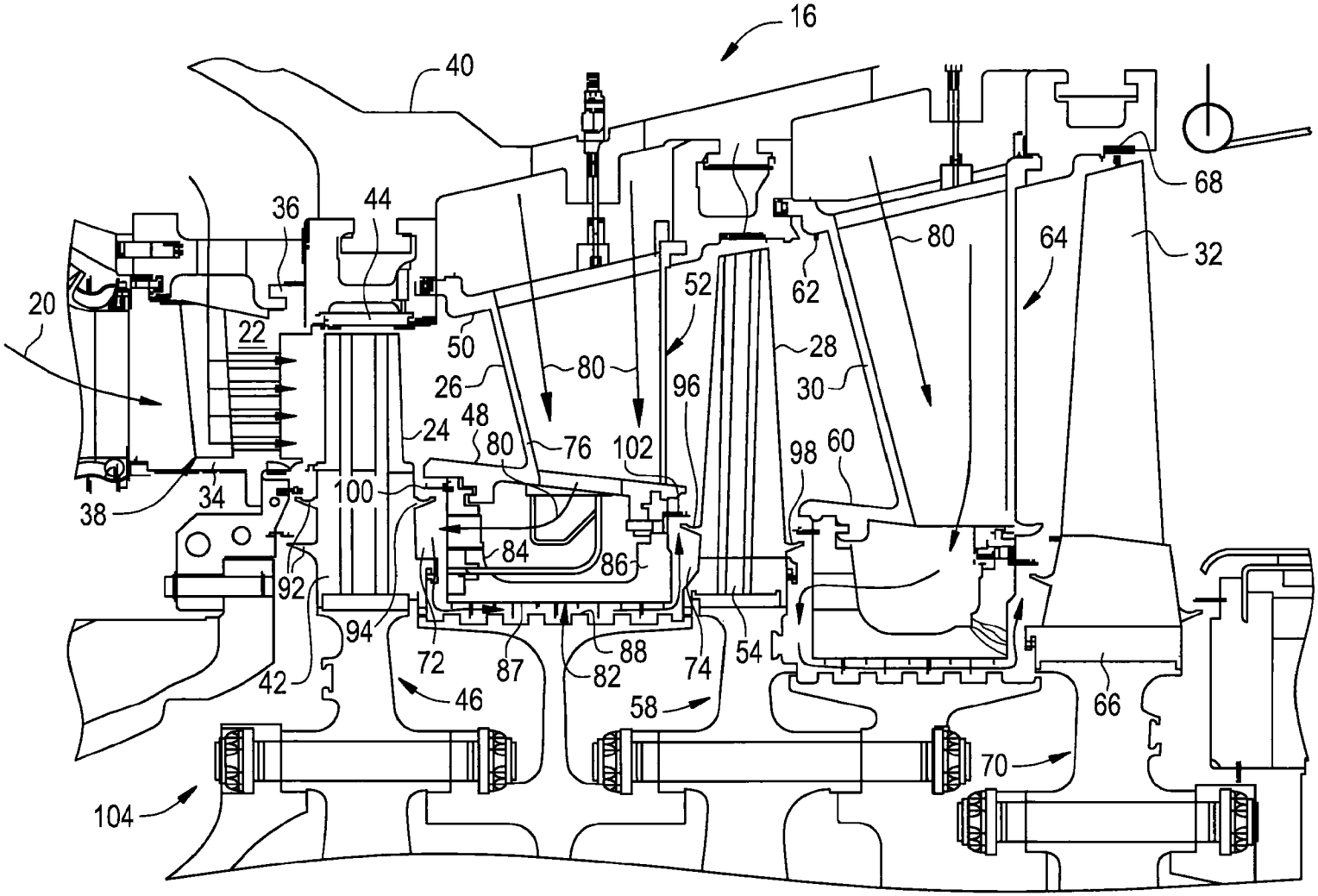
FIG. 2 is an enlarged sectional view through a portion of the gas turbine engine of FIG. 1.
Figure 3:
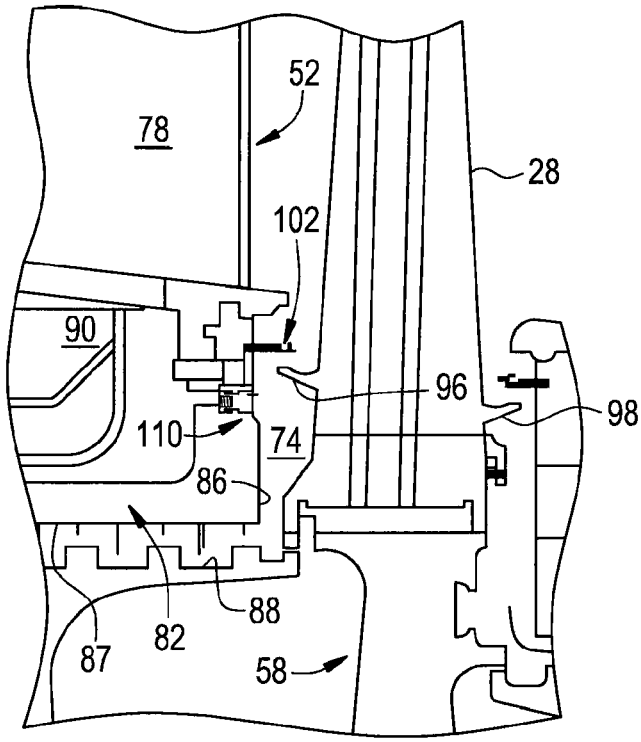
FIG. 3 is an enlarged sectional view through a portion of the gas turbine engine of FIG. 1 in a cold, non-operational state.
Figure 4:
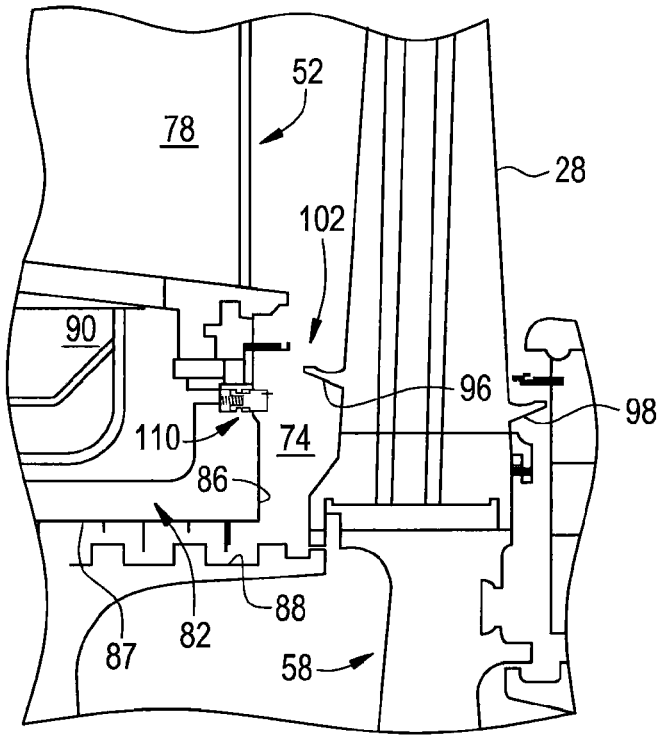
FIG. 4 is an enlarged sectional view through a portion of the gas turbine engine of FIG. 1 in a hot, operational state.

Illustrated in FIGS. 1 and 2 is a portion of a gas turbine engine 10. The engine is axisymmetrical about a longitudinal, or axial centerline axis and includes, in serial flow communication, a multistage axial compressor 12, a combustor 14, and a multi-stage turbine 16.

During operation, compressed air 18 from the compressor 12 flows to the combustor 14 that operates to combust fuel with the compressed air for generating hot combustion gas 20. The hot combustion gas 20 flows downstream through the multi-stage turbine 16, which extracts energy therefrom.

As shown in FIGS. 1 and 2, an example of a multi-stage axial turbine 16 may be configured in three stages having six rows of airfoils 22, 24, 26, 28, 30, 32 disposed axially, in direct sequence with each other, for channeling the hot combustion gas 20 therethrough and, for extracting energy therefrom.

The airfoils 22 are configured as first stage nozzle vane airfoils. The airfoils are circumferentially spaced apart from each other and extend radially between inner and outer vane sidewalls 34, 36 to define first stage nozzle assembly 38. The nozzle assembly 38 is stationary within the turbine housing 40 and operates to receive and direct the hot combustion gas 20 from the combustor 14. Airfoils 24 extend radially outwardly from the perimeter of a first supporting disk 42 to terminate adjacent first stage shroud 44. The airfoils 24 and the supporting disk 42 define the first stage turbine rotor assembly 46 that receives the hot combustion gas 20 from the first stage nozzle assembly 38 to rotate the first stage turbine rotor assembly 46, thereby extracting energy from the hot combustion gas.

The airfoils 26 are configured as second stage nozzle vane airfoils. The airfoils are circumferentially spaced apart from each other and extend radially between inner and outer vane sidewalls 48 and 50 to define second stage nozzle assembly 52. The second stage nozzle assembly 52 is stationary within the turbine housing 40 and operates to receive the hot combustion gas 20 from the first stage turbine rotor assembly 46. Airfoils 28 extend radially outwardly from a second supporting disk 54 to terminate adjacent second stage shroud 56. The airfoils 28 and the supporting disk 54 define the second stage turbine rotor assembly 58 for directly receiving hot combustion gas 20 from the second stage nozzle assembly 52 for additionally extracting energy therefrom.

Similarly, the airfoils 30 are configured as third stage nozzle vane airfoils circumferentially spaced apart from each other and extending radially between inner and outer vane sidewalls 60 and 62 to define a third stage nozzle assembly 64. The third stage nozzle assembly 64 is stationary within the turbine housing 40 and operates to receive the hot combustion gas 20 from the second stage turbine rotor assembly 58. Airfoils 32 extend radially outwardly from a third supporting disk 66 to terminate adjacent third stage shroud 68. The airfoils 32 and the supporting disk 66 define the third stage turbine rotor assembly 70 for directly receiving hot combustion gas 20 from the third stage nozzle assembly 64 for additionally extracting energy therefrom. The number of stages utilized in a multistage turbine 16 may vary depending upon the particular application of the gas turbine engine 10.

As indicated, first, second and third stage nozzle assemblies 38, 52 and 64 are stationary relative to the turbine housing 40 while the turbine rotor assemblies 46, 58 and 70 are mounted for rotation therein. As such, there are defined between the stationary and rotational components, cavities that may be referred to as wheel spaces. Exemplary wheel spaces 72 and 74, illustrated in FIG. 2, reside on either side of the second stage nozzle assembly 52 between the nozzle assembly and the first stage turbine rotor assembly 46 and the nozzle assembly and the second stage rotor assembly 58.

The turbine airfoils as well as the wheel spaces 72, 74 are exposed to the hot combustion gas 20 during operation of the turbine engine 10. To assure desired durability of such internal components they are typically cooled. For example, second stage nozzle airfoils 26 are hollow with walls 76 defining a coolant passage 78. In an exemplary embodiment, a portion of compressed air from the multistage axial compressor 12 is diverted from the combustor and used as cooling air 80 that is channeled through the airfoil 26 for internal cooling. Extending radially inward of the second stage inner vane sidewall 48 is a diaphragm assembly 82. The diaphragm assembly includes radially extending side portions 84 and 86 with an inner radial end 87 closely adjacent the rotor surface 88. An inner cooling passage 90 receives a portion of the cooling air 80 passing through the airfoil coolant passage 78 and disperses the cooling air into the wheel spaces 72 and 74 to maintain acceptable temperature levels therein. Sealing features 92 and 94, referred to as "angel wings", are disposed on the upstream and downstream sides of the first stage turbine airfoils 24. Similarly, sealing features 96 and 98 are disposed on the upstream and downstream sides of the second stage turbine airfoils 28. The sealing features, or angel wings, extend in an axial direction and terminate within their associated wheel spaces closely adjacent to complementary sealing lands such as 100 and 102, mounted in and extending from radially extending side portions 84, 86 of the second stage diaphragm assembly 82. During operation of the turbine engine, leakage of cooling air 80, flowing into the wheel spaces 72 and 74 from the inner cooling passage 90 of the diaphragm assembly 82, is controlled by the close proximity of the upstream and downstream sealing features 94, 96 and the sealing lands 100, 102. Similar sealing features and sealing lands may also be used between stationary and rotating portions of the other turbine stages of the turbine engine 10.

During operation of the gas turbine engine 10, especially as the temperature of the engine transitions from a cold state to a hot state following start-up, the various components of the engine, already described above, may experience some degree of thermal expansion resulting in dimensional changes in the engine 10 which must be accounted for. For instance, as the temperature rises, the entire turbine rotor assembly 104 may expand axially relative to the fixed nozzle assemblies as well as the turbine housing 40. Due to the manner in which the turbine rotor assembly 104 is supported within the turbine housing 40, such axial expansion is primarily in the down stream direction relative to the housing, FIG. 1. As a result of the downstream relative movement, the axial overlap spacing between the downstream sealing features 94 of first stage turbine rotor assembly 46 and the second stage upstream sealing land 100 may increase, resulting in a decrease in the leakage of cooling air 80 into the main gas stream 20 from wheel space 72. Conversely, the axial overlap spacing between the second stage downstream sealing land 102 and the upstream sealing feature 96 of the second stage turbine rotor assembly 58 may decrease. Baring contact, the increase and/or decrease between sealing features is of minor consequence. However, since the cooling air 80 is diverted air from the axial compressor, its usage for purposes other than combustion will directly influence the efficiency of the gas turbine engine 10 and the designed operation of the wheel spaces. Each wheel space is designed to maintain a specific flow of cooling air to prevent the ingestion of the main gas stream 20 therein. Therefore, the decrease in axial overlap spacing between the upstream sealing features 96 of second stage turbine rotor assembly 58 and the second stage downstream sealing land 102 is undesirable because the incorrect quantity of flow is delivered to the wheel space 74. Accordingly, wheel space 74, with its decrease in axial overlap spacing will leak more than the designed flow into the main gas stream 20.

Figure 5:
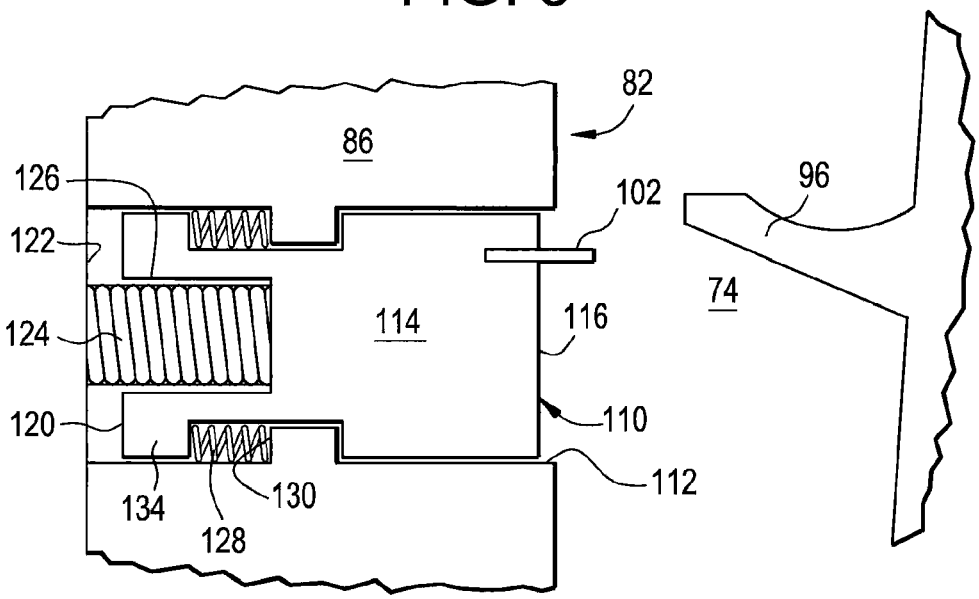
FIG. 5 is an enlarged sectional view of a portion of FIG. 3 taken at Circle 5.
Figure 6:
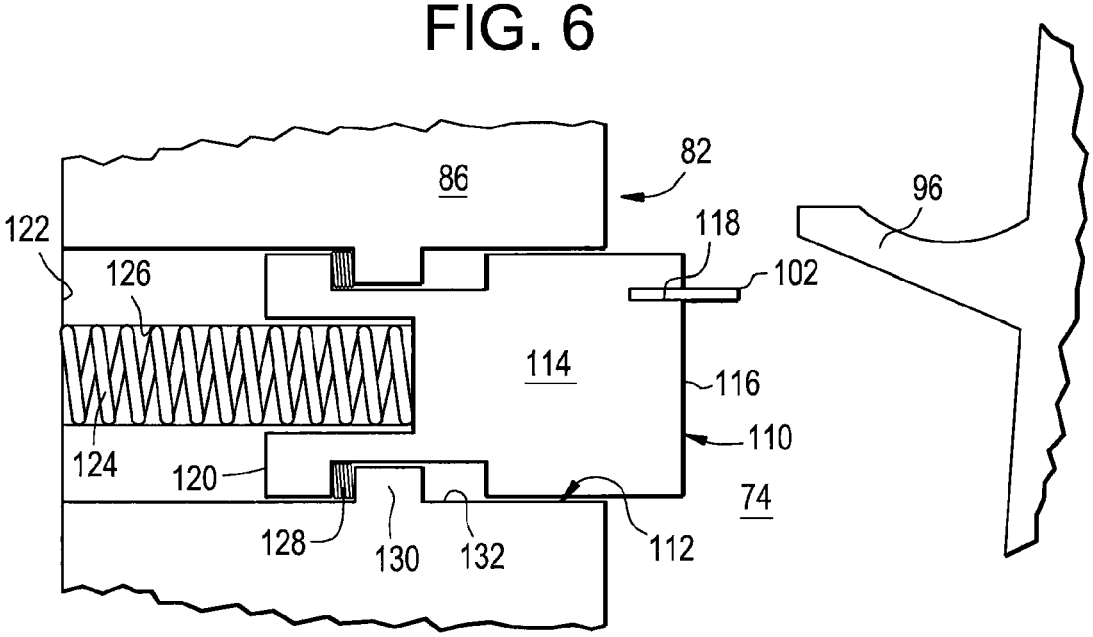
FIG. 6 is an enlarged sectional view of a portion of FIG. 4 taken at Circle 6.

In a non-limiting, exemplary embodiment, the second stage downstream sealing land 102 is associated with a sealing land assembly 110, FIGS. 5 and 6, mounted for relative axial movement within opening 112 in the radially extending side portion 86 of the diaphragm assembly 82. The sealing land assembly 112 includes a carrier piston 114 having a first, outer end 116 configured to receive sealing land 102 in receiving slot 118 formed therein. A second end 120 of the carrier piston 114 resides adjacent to the inner end 122 of the opening 112 and includes a first biasing member such as spring 124 disposed therebetween. In the embodiment illustrated the spring 124 is received in an opening 126 formed in the second end 120 of the carrier piston 114, however other configurations for receiving and positioning the spring 124, as well as other spring configurations are contemplated. As configured, the spring 124 biases the carrier piston and associated sealing land 102 outwardly from the radially extending side portion 86 of the diaphragm assembly 82 and into the wheel space 74.

In the non-limiting embodiment just described, biasing spring 124 is constructed of a material generally referred to as a shape memory alloy metal such as a nickel-titanium ("NiTi") blend. Shape memory alloy can exist in two different, temperature dependant crystal structures or phases (i.e. martensite (lower temperature) and austenite (higher temperature)), with the temperature at which the phase change occurs dependent primarily on the composition of the alloy. Two-way shape memory alloy has the ability to recover a preset shape upon heating above the transformation temperature and to return to a certain, alternate shape upon cooling below the transformation temperature. Biasing spring 124 may be configured from a NiTi alloy having a phase change within the heat transient of the gas turbine engine 10. As the gas turbine engine 10 transitions from cold to hot following start-up, the spring 124 will proceed through its martensitic phase FIG. 5 to its austenitic phase FIG. 6 resulting in carrier piston 114 along with associated downstream sealing land 102, being biased in the direction of the wheel space 74 and the downstream sealing feature 96. As a result, the desired close physical spacing between the upstream sealing feature 96 of the second stage turbine rotor assembly 58 and the second stage downstream sealing land 102 is maintained in spite of the downstream axial growth of the turbine rotor assembly 104. The result is reduced passage of cooling air 80 from within the downstream wheel space 74 between second stage turbine rotor assembly 58 and the diaphragm assembly 82 of the second stage nozzle assembly 52, thereby improving the efficiency of the gas turbine engine and maintaining control of the wheel space cooling air flow.

Sealing land assembly 110 may also include a second biasing member such as return spring 128 which, in the embodiment shown in FIGS. 5 and 6 is disposed about the outer circumference of the carrier piston 114 between a fixed annular biasing ledge 130 extending radially inwardly from the walls 132 of the opening 112 and a corresponding annulus 134 disposed adjacent the inner end 122 of the carrier piston 114. As the gas turbine engine 10 transitions from hot to cold following shut-down, the shape memory alloy spring 124 will proceed through its austenitic phase FIG. 6, to its martensitic phase FIG. 5 resulting in carrier piston 114 along with associated downstream sealing land 102, being biased axially out of the wheel space 74 and away from the downstream sealing feature 96. As a result, the desired close physical spacing between the upstream sealing feature 96 of the second stage turbine rotor assembly 58 and the second stage downstream sealing land 102 is maintained in spite of the upstream axial contraction of the turbine rotor assembly 104 as it cools. By exerting a spring load against fixed biasing ledge 130 and piston annulus 134, the return spring 128 exerts a bias on the carrier piston 114 in addition to any bias provided by spring 124 to thereby assure that the carrier piston 114 is returned to a fully seated position within the opening 112. Full retraction of the carrier piston 114 and associated sealing land 102 is necessary to avoid clearance issues between the nozzle assemblies and the turbine rotor assemblies upon disassembly of the multistage turbine 16 for servicing or modification.

While exemplary embodiments of the invention have been described herein with application primarily to a second stage of a multi-stage turbine, the focused description is for simplification only and the scope of the invention is not intended to be limited to that single application. The application of the described invention can be applied to similar turbine engine assemblies and components throughout the various stages.

While exemplary embodiments of the invention have been described with reference to shape memory alloys of a nickel-titanium composition, other compositions such as nickel-metallic cobalt, copper-zinc or others that exhibit suitable behavior at the desired temperatures of the turbine engine may be utilized. Additionally, while the described embodiment has illustrated the use of the shape memory alloy having expanding features which extend sealing land 102, for instance, as the engine temperature increases, it is contemplated that a shape memory alloy application in which the material is configured to have a contractive reaction as it passes from its martensitic phase to its austenitic phase may result in a retraction of a downstream sealing land, away from the wheel space in order to maintain desired spacing of, for instance, land 100 and sealing feature 94 as the sealing feature encroaches on the land as a result in the downstream growth of the turbine rotor assembly 104 following start-up and heat-up of the turbine engine 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbine engine comprising:

a first turbine engine assembly;

a second turbine engine assembly disposed adjacent to the first turbine engine assembly;

a wheel space defined between the first turbine engine assembly and the second turbine engine assembly and configured to receive cooling air therein;

a sealing feature located on the first turbine engine assembly and extending axially into the wheel space;

a sealing land assembly, having a sealing land associated with a moveable member, installed in an opening in the second turbine assembly, a biasing member constructed of shape memory alloy associated with the moveable member and configured to bias the moveable member and associated sealing land axially into the wheel space towards the sealing feature as the turbine engines transitions from a cold state to a hot state.

2. The turbine engine of claim 1, wherein the biasing member is configured as a two-way shape memory alloy having a first axial length in a cold, martensitic state and a second, longer axial length in a hot, austenitic state.

3. The turbine engine of claim 1, the shape memory alloy having a composition such that a phase change from a cold, martensitic state to a hot, austenitic state occurs as the gas turbine engine transitions from a cold state to a hot state.

4. The turbine engine of claim 1, wherein the shape memory alloy comprises a nickel-titanium alloy.

5. The turbine engine of claim 1, wherein the biasing member is configured to bias the moveable member and associated sealing land axially out of the wheel space and away from the sealing feature as the turbine engine transitions from a hot state to a cold state.

6. A turbine engine comprising:

a first, rotatable turbine rotor assembly;

a second, stationary nozzle assembly disposed adjacent to the first, rotatable turbine rotor assembly;

a wheel space defined between the first, rotatable turbine rotor assembly and the second, stationary nozzle assembly and configured to receive cooling air therein; and a sealing feature located on the first, rotatable turbine rotor assembly and extending axially into the wheel space;

a sealing land assembly, having a sealing land associated with a moveable member, installed in an opening in the second, stationary nozzle assembly;

a biasing member constructed of shape memory alloy associated with the moveable member and configured to bias the moveable member and associated sealing land axially into the wheel space towards the sealing feature as the turbine engine transitions from a cold state to a hot state.

7. The turbine engine of claim 6, wherein the biasing member is configured as a two-way shape memory alloy having a first axial length in a cold, martensitic state and a second, longer axial length in a hot, austenitic state.

8. The turbine engine of claim 6, wherein the shape memory alloy has a composition such that a phase change from a cold, martensitic state to a hot, austenitic state occurs as the gas turbine engine transitions from a cold state to a hot state.

9. The turbine engine of claim 6, wherein the biasing member is configured to bias the moveable member and associated sealing land axially out of the wheel space and away from the sealing feature as the turbine engine transitions from a hot state to a cold state.

10. The turbine engine of claim 6, wherein the shape memory alloy comprises a Nickel-Titanium alloy.

11. A turbine engine comprising:

a turbine housing having an upstream and a downstream end;

a stationary nozzle assembly disposed within the housing in fixed relationship to the housing;

a turbine rotor assembly supported within the housing for rotation therein and operable, during operation of the turbine engine, to thermally expand relative to the stationary nozzle assembly;

a wheel space defined between the stationary nozzle assembly and the rotatable turbine rotor assembly and configured to receive cooling air therein;

a sealing feature located on the turbine rotor assembly and extending axially into the wheel space;

a sealing land assembly, having a sealing land associated with a moveable member, installed in an opening in the stationary nozzle assembly;

a biasing member, constructed of shape memory alloy having a composition such that a phase change from a cold, martensitic state to a hot, austenitic state is within the heat transient of the gas turbine engine, associated with the moveable member and configured to bias the moveable member and associated sealing land axially into the wheel space towards the sealing feature as the turbine engine transitions from a cold state to a hot state.

12. The turbine engine of claim 11, wherein the biasing member is configured to bias the moveable member and associated sealing land axially out of the wheel space and away from the sealing feature as the turbine engine transitions from a hot state to a cold state.

13. The turbine engine of claim 11, wherein the shape memory alloy comprises a Nickel-Titanium alloy.

* * * * *